US005445797A

United States Patent [19]

Flesher

[11] Patent Number: 5,445,797

[45] Date of Patent: Aug. 29, 1995

[54] MICRO-PIPETTOR ASSEMBLY

[76] Inventor: Robert W. Flesher, 611 E. Seminary Ave., Baltimore, Md. 21286

[21] Appl. No.: 260,689

[22] Filed: Jun. 14, 1994

[51] Int. Cl.[6] ..... B09L 3/02

[52] U.S. Cl. ..... 422/100; 422/99; 73/864.11

[58] Field of Search ..... 73/864.11, 864.14, 864.35; 422/99, 100

[56] References Cited

U.S. PATENT DOCUMENTS 917,442 4/1969 Hutchinson ..... 73/864.11
5,125,278 6/1992 Foldenauer ..... 73/864.11

FOREIGN PATENT DOCUMENTS 2653051 11/1976 Germany .
319763 7/1981 U.S.S.R. .

OTHER PUBLICATIONS

Siemer, D. D., Appl. Spec. vol. 30:2 237–238.

*Primary Examiner*—Lyle A. Alexander
*Assistant Examiner*—Michael L. McGlashen
*Attorney, Agent, or Firm*—Sterne, Kessler, Goldstein & Fox

[57] ABSTRACT

A pipettor assembly includes a pipettor and a pipette tip. In one embodiment, the pipettor has a tubular body which defines a hollow central bore. The central bore is closed at a first end and open at a second end. A cutout penetrates a side wall of the body near the second end to expose the central bore. A resilient, flexible member sealably covers the cutout. The pipette tip is coupled to the second end of the pipettor. A liquid is drawn into the pipette tip by depressing and then releasing the flexible member. A liquid is expelled by depressing the flexible member. In another embodiment, the pipettor has an elongated body with an air passage between the second and a side portion of the body. A flexible membrane is sealably attached to the side portion of the body. A deflection of the flexible membrane will cause a change in the volume of the air passage for picking-up and expelling liquids from the pipette tip.

10 Claims, 3 Drawing Sheets

110
101
102
104
119
112
106
100
103
108
120
114
116
118

MICRO-PIPETTOR ASSEMBLY

BACKGROUND OF THE INVENTION

1. Field of the Invention

The invention relates generally to a pipettor and, more particularly, to an inexpensive micro-pipettor for use with a pipette tip.

2. Related Art

A micro-pipettor is used to dispense quantities of a liquid in the micro-liter range. The micro-pipettor is generally used with a pipette tip. The pipettor provides a suction to the tip to draw a fluid into the tip (and possibly into the pipettor also). The pipettor can also exert a pressure in the tip to expel the liquid from the tip.

The conventional pipettor uses a movable piston to pull liquids into or expel liquids out of the tip. Such pipettors are precisely calibrated so that a linear movement of the piston is related to a volume change within the pipettor. A precision mechanical control mechanism is used to move the piston and to relate the distance moved to the volume of liquid either pulled in or pushed out of the pipette.

Such conventional pipettors tends to be expensive and difficult to clean. A need exists for a pipettor which is inexpensive, effective and easy to clean.

SUMMARY OF THE INVENTION

The invention is a micro-pipettor pen for use with a pipette tip. In a first embodiment, the pipettor pen includes an elongated tubular body having a hollow lumen or central bore. The central bore is sealed at a first end and is open at a second end. The second end is configured to mate with a pipette tip. A cut-out in a side of the body near the second end exposes the central bore. A flexible member (e.g., a short length of flexible tubing) placed over the cut-out seals the central bore and forms a push-button for operating the pipettor.

In the preferred embodiment, a short length of silicone tubing is slid over the body to enclose the body at the cut-out. The tubing has an inner diameter slightly smaller than the outer diameter of the body. This allows the tubing to snugly fit the body to seal the cut-out portion.

The body is tapered at the second end to receive the pipette tip. The tip is slid onto the tapered portion of the body and is maintained in place by a friction fit. The friction fit provides a sealed connection between the body and the tip.

During use, the pipettor is held in a person's hand like a pen. In this position, the person's index finger rests over the flexible member. By depressing the flexible member, the volume of the central bore can be slightly changed. A liquid may then be drawn into the tip by releasing the pressure of the index finger on the flexible member. Releasing the pressure on the flexible member allows the flexible member (by its resiliency) to return to its un-depressed shape. This creates a suction in the central bore, drawing the liquid into the tip.

Once a liquid has been drawn into the pipette tip, it may be expelled by again pressing the index finger against the flexible member. This causes the pressure within the central bore of the pipettor body to increase and expel the liquid from the pipette tip. By controlling the amount of pressure exerted, the quantity of liquid expelled by the pipette tip can be controlled.

In the preferred embodiment, the pipettor pen of the invention is used with a graduated pipette tip. The graduated pipette tip is formed from a translucent or transparent material. Calibrated graduation marks are formed on the outside of the pipette tip. A precise quantity of liquid may be drawn into the pipette tip by depressing the flexible member, placing the pipette tip in a liquid and then releasing pressure on the flexible member until a desired quantity of liquid has been pulled into the pipette tip as indicated by the graduation marks. The precise quantity of liquid within the pipette tip may then be deposited as desired by depressing the flexible member to expel the liquid.

The pipettor pen in the invention may be made from a variety of materials using a variety of different manufacturing techniques. For example, the body may be made from glass, cellulose acetate butyrate, acrylic, polycarbonate, aluminum or a variety of engineering plastics. Manufacturing techniques for forming the body include, for example, injection-molding or extrusion. The cut-out may be formed by machining or as part of a molding process.

In an alternate embodiment, the pipettor pen includes an injection-molded body having a tapered end for mating with a pipette tip. An air passage within the body connects the pipette tip to a side portion of the body. A button assembly is attached to the side portion of the body to seal the air passage.

The button assembly is a deformable membrane formed, for example, from silicone or Lexan. The button assembly includes a pick-up button and a dispense button. Each button is deformable through a limited range and may provide a positive snap or click when pressed. Depressing and releasing the pick-up button will cause the pipettor to draw a liquid into the pipette tip. Similarly, depressing the dispense button will cause the pipettor to expel the liquid from the pipette tip. The dispense button will displace a greater volume than the pick-up button. This allows surface tension within the pipette tip to be overcome so that the liquid may be completely expelled.

This embodiment of the invention provides a coarsely calibrated draw, because the limited range movement of the flexible membrane will cause a predetermined displacement within the air passage of the body. A similar calibration may be achieved in the first embodiment of the invention by forming the cutout portion of the body with a stepped configuration to form a pick-up stop and a dispense stop. By depressing the flexible member against the pick-up stop, a predetermined volume displacement will occur within the pipettor. When the flexible member is released, a calibrated amount of liquid will be drawn into the pipette tip. This coarse calibration may be used in conjunction with the calibrated pipette tip or may be used as the sole means for measuring a quantity of liquid.

The dispense stop allows a greater volume to be displaced within the pipettor as compared with the pick-up stop. This greater volume allows all of the liquid to be expelled from the pipet tip and accounts for the effects of surface tension.

The foregoing and other features and advantages of the invention will be apparent from the following more particular description of a preferred embodiment of the invention, as illustrated in the accompanying drawings.

DETAILED DESCRIPTION OF THE PREFERRED EMBODIMENT

The preferred embodiment of the invention is discussed in detail below with reference to the figures where like reference numbers indicate like elements. Also in the figures, the left most digits of each reference number corresponds to the figure in which the reference number is first used. While specific part numbers and/or configurations are discussed, it should be understood that this is done for illustration purposes only. A person skilled in the relevant art will recognize that other components and configurations may be used without parting from the spirit and scope of the invention.

Figures 1, 2:
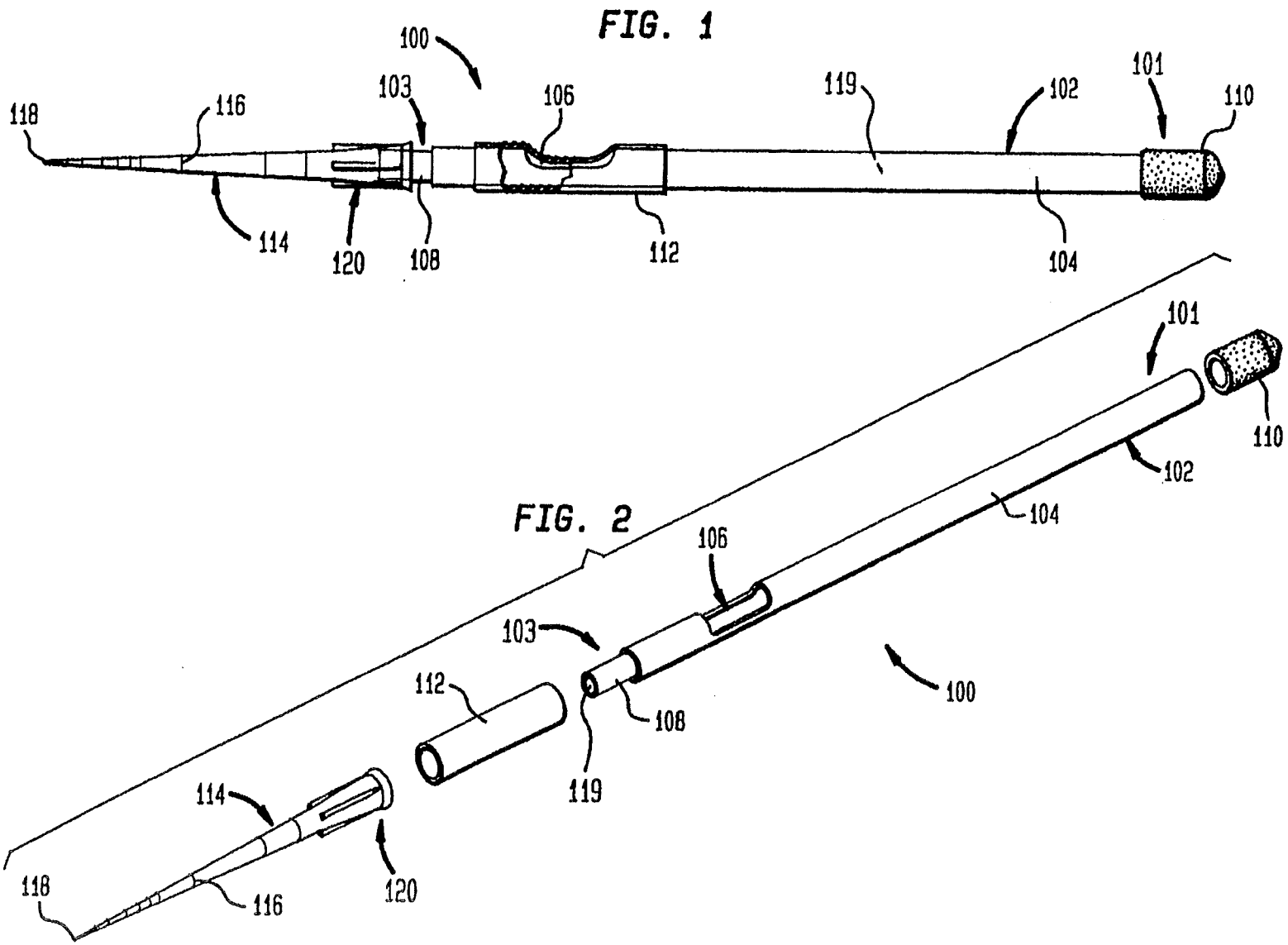
FIG. 1 is a side view of the micro-pipettor pen of the invention.
FIG. 2 is an exploded view showing the individual elements illustrated in FIG. 1.

FIGS. 1 and 2 show the micro-pipettor pen 100 of the invention. Pipettor pen 100 includes a pipettor 102 and a pipette tip 114. Pipettor 102 includes a tubular body 104, a flexible member or membrane 112 and a cap 110. Body 104 is a tube having a hollow lumen or central bore 119. Lumen 119 is closed at a :first end 101 by cap 110. Lumen 119 is open at a second end 103. Body 104 further includes a tapered portion 108 at second end 103.

A cut-out 106 is formed in body 104 near second end 103. Cut-out 106 extends through the wall of body 104 to expose lumen 119. Flexible membrane 112 is placed over body 104 to cover and seal cut-out 106.

Pipette tip 114 is a conically shaped tip having a central bore or lumen open at both ends. At a wide end 120, tip 114 is configured to mate with tapered portion 108 of body 104 by a friction fit to allow substantially air-tight coupling of the central bore of tip 114 with lumen 119 of body 104. At the narrow end of pipette tip 114, an apex opening 118 is provided for drawing liquids into or expelling liquids out of pipettor pen 100.

Pipette tip 114 also includes a plurality of graduation marks 116. Graduation marks 116 are calibrated to measure precise quantities of liquids drawn into tip 114. Tip 114 is made from a transparent or translucent material which allows a user of pipettor pen 100 to visually compare the level of liquid drawn into tip 114 with graduation marks 116.

Pipette tip 114 may be formed by injection-molding as is known in the art. For example, a suitable pipette tip for use with pipettor 102 of the invention is described in U.S. Pat. No. 5,223,225 to Gautsch. Other suitable pipettor tips are also commercially available.

In the preferred embodiment of the invention, body 104 is machined from stock tubing of cellulose acetate butyrate. However, body 104 could also be injection-molded using known materials and techniques. Injection-molding would reduce manufacturing costs. Body 104 may also be formed from glass, cellulose acetate butyrate, acrylic, polycarbonate, aluminum or an engineering plastic. Cut-out 106 may be formed by machining, molding or other processes depending on the material selected for body 104.

Flexible membrane 112 may be made from silicone, robber, or other flexible, resilient materials. In the preferred embodiment, flexible membrane 112 is a robe having an inner diameter slightly smaller than an outer diameter of body 104. The flexible robe is stretchingly slid (i.e., stretched and slid) over body 104 to cover cutout 106 and thereafter elastically conforms to the shape of body 104 to seal cutout 106.

In an injection-molded embodiment of the present invention, flexible membrane 112 may be implemented as a thinned wall formed as an integral part of body 104 in the place of cut-out 106. This thinned wall may also be "bubbled out" from the surface of body 104 to permit displacement of a greater volume when depressed.

In the presently preferred embodiment of the invention, body 104 has an overall length of 6.0 inches, an outer diameter of 0.280 inches and a central bore diameter of 0.060 inches. Tapered portion 108 has a length of between 0.370 and 0.500 inches and has an outwardly extending taper of approximately 3°. Cut-out 106 is approximately 0.75 inches long and extends down into body 104 to a depth in the range of 0.110 to 0.140 inches. At this range of depths, cut-out 106 will extend either to the edge of or completely through lumen 119 of body 104. The near edge of cut-out 106 is approximately one inch back from second end 103. These dimensions are selected to provide a micro-pipettor pen Which fits easily within a persons hand and can be used with standard pipettor tips for handling liquids in the one to twenty (1–20) micro-liter range.

Other size pipettors may be produced in accordance with the present invention. For example, a pipettor for use with quantities of liquid in the milliliter range may also be produced. In addition, the diameter of body 104 and the diameter of lumen 119, as well as the size and depth of cut-out 106, may be modified to adjust the performance/sensitivity of pipettor 102.

Figure 3:
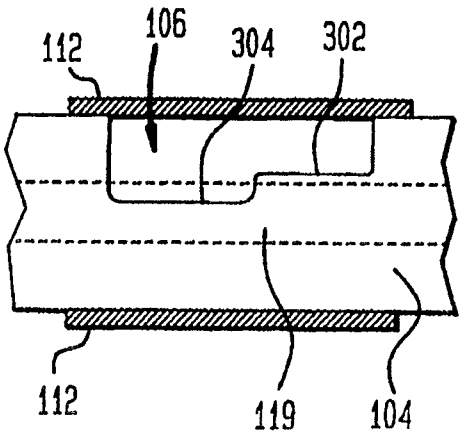
FIG. 3 is cross-sectional view of a portion of a body 104 of FIG. 1 illustrating an alternate embodiment of a cutout portion 106.

As discussed above, pipettor pen 100 is calibrated by using a graduated pipette tip. In an alternate embodiment, a coarse calibration may be achieved by limiting the draw which can be made by depressing flexible membrane 112 at cut-out 106. FIG. 3 illustrates implementation of such an embodiment.

Figure 4A:
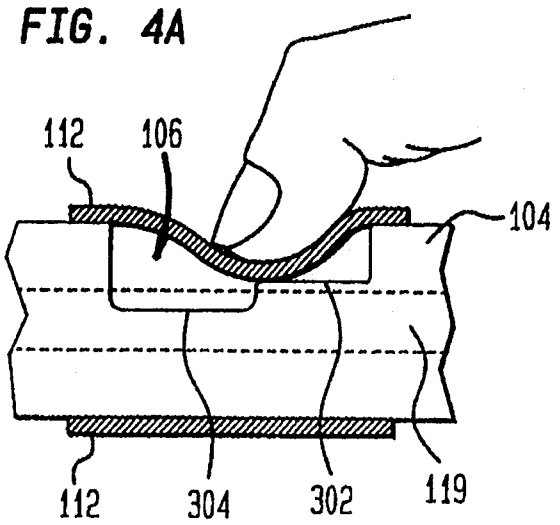
FIGS. 4A and 4B illustrate operation of the embodiment of the invention shown in FIG. 3.

FIG. 3 is a cross-sectional view of body 104 at cut-out 106. In this embodiment, cut-out 106 is produced with a pick-up stop 302 and a dispense stop 304. A liquid may be drawn into the pipette tip by pressing flexible membrane 112 against pick-up stop 302 as illustrated in FIG. 4A. When flexible membrane 112 is released, it will return to its normal position, thereby drawing a liquid into the pipet tip. Pick-up stop 112 limits the distance through which flexible membrane 112 can be depressed. So long as flexible membrane 112 is pressed firmly against pick-up stop 302, a known displacement will occur within body 104. When flexible membrane 112 is released, a coarsely calibrated draw will result.

Figure 4B:
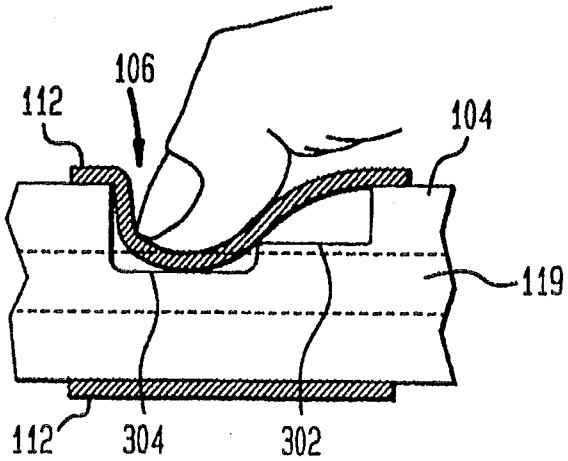

Dispense stop 304 is provided for the expulsion or blow-out of the liquid from the pipettor. As illustrated in FIG. 3, dispense stop 304 is deeper than pick-up stop 302. That is, depressing flexible membrane 112 against dispense stop 304, as illustrated in FIG. 4B, will allow a greater displacement in body 104 than will depressing flexible membrane 112 against pick-up stop 302. For example, stops 302,304 may be configured such that dispense stop 304 allows twice the volume displacement of pick-up stop 302. This greater displacement allows the effects of surface tension to be overcome so that all of the liquid within the pipet tip can be completely expelled.

In this embodiment of the invention, the depths of stops 302,304 may be modified to produce pipettors with different draw capacities. For example, pipettors may be produced with 5, 10, or 20 microliter draw capacities. The different capacity pipettors may be identified using a color-coding scheme.

Furthermore, stops 302,304 may be configured as a tapering incline rather than discreet steps. Such an angled surface would allow a continuous range of draws to be implemented by altering the position along the incline that the membrane is pressed against.

Figure 5C:
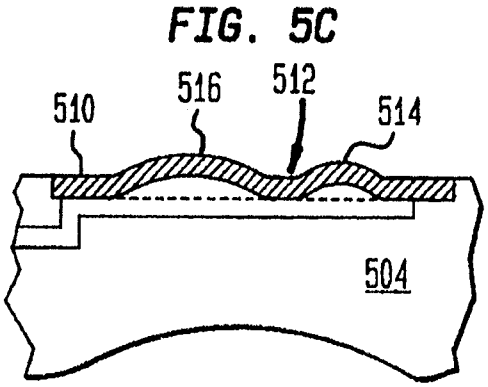
FIG. 5C is a cross-sectional view of a portion of a body 504 of FIGS. 5A and 5B showing an air passage 510 and a button assembly 512.
Figure 5A:
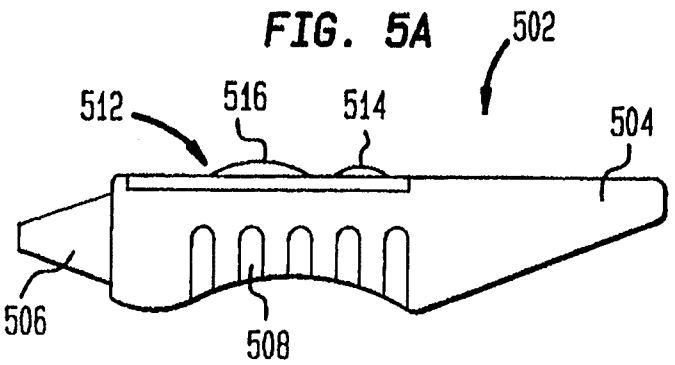
FIGS. 5A and 5B an alternate embodiment of the pipettor of the invention.
Figure 5B:
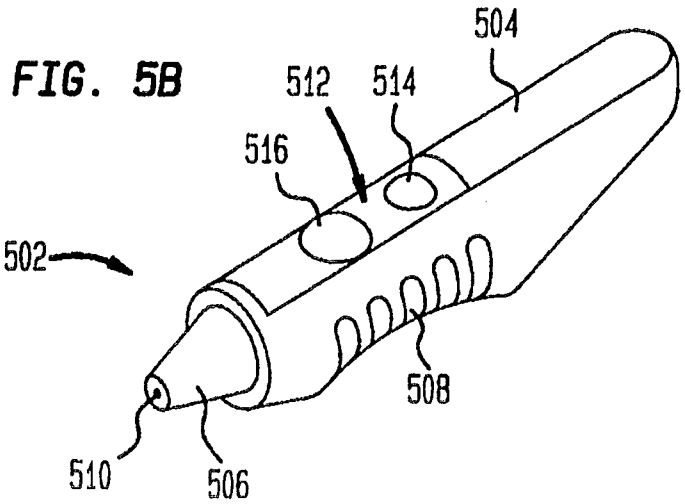

FIGS. 5A and 5B illustrate yet another embodiment of the invention. In this embodiment, a pipettor pen 502 includes an injection-molded body 504 and a button assembly 512. Body 504 is formed in an ergonomic shape with a plurality of indents 508 to improve a user's grip on the pipettor. Body 504 has a tapered end portion 506 to mate with a pipette tip.

Button assembly 512 includes a pick-up button 514 and a dispense button 516. As illustrated in FIG. 5C, button assembly 512 is attached to body 504 to cover and seal an air passage 5 10 which opens onto the side of body 504. Air passage 510 includes a space beneath button assembly 512 and a passage through to tip 506 as illustrated in FIGS. 5B and 5C.

In the preferred embodiment, button assembly 512 is a deformable membrane formed from, for example, silicone or Lexan. Buttons 514,516 may provide a positive snap or click when pressed. Depressing pick-up button 514 will cause the membrane to deform inward. When button 514 is released, it will return to its original shape. The changing volume which results within air passage 510 will draw a liquid into the pipette tip (not shown in FIGS. 5A–5C) coupled to tapered end 506.

Similarly, depressing dispense button 516 will cause the membrane to deform inward. The changing volume which results within air passage 510 will expel the liquid from the pipette tip. Button 516 will displace a greater volume than button 514. This allows surface tension within the pipette tip to be overcome so that the liquid may be completely expelled.

The embodiments illustrated in FIGS. 3–5 provide a coarse draw calibration by limiting the draw of the pipettor. This calibration may be relied on for the dispensing of a quantity of liquid. In this case, a calibrated pipette tip is not required and the pipettor may be used with a standard, ungraduated pipette tip.

While the invention has been particularly shown and described with reference to a preferred embodiment thereof, it will be understood by those skilled in the art that various changes in form and details may be made therein without departing from the spirit and scope of the invention.

What is claimed is:

1. A pipettor comprising:

(a) an elongated tubular body having a hollow central bore, said central bore being sealed at a first end of said body and being open at a second end of said body, said second end being configured to mate with a pipette tip;

(b) a cutout in a side of said body, said cutout penetrating a wall of said body to expose said central bore, said cutout defining a pick-up stop and a dispense stop; and (c) a resilient, flexible member sealably covering said cutout portion, wherein said pick-up stop limits the depth to which said flexible member can be depressed into said cutout to a first depth and said dispense stop limits the depth to which said flexible member can be depressed into cutout to a second depth, said second depth being greater than said first depth.

2. The pipettor of claim 1, wherein said cutout is located near said second end of said body.

3. The pipettor of claim 2, wherein said resilient, flexible member comprises a tube encasing said body at said cutout.

4. The pipettor of claim 3, wherein said tube has an inner diameter slightly smaller than an outer diameter of said body and wherein said tube is stretchingly slid over said body to cover said cutout, said tube elastically conforming to seal said cutout.

5. The pipettor of claim 4, wherein said second end of said body comprises a tapered portion configured to mate with said pipette tip.

6. A pipettor assembly comprising:

(a) an elongated tubular body having a hollow central bore, said central bore being sealed at a first end of said body and being open at a second end of said body, said second end being configured to mate with a pipette tip;

(b) a cutout in a side of said body, said cutout penetrating a wall of said body to expose said central bore, said cutout defining a pick-up stop and a dispense stop;

(c) a resilient, flexible member sealably covering said cutout portion, wherein said pick-up stop limits the depth to which said flexible member can be depressed into said cutout to a first and said dispense stop limits the depth to which said flexible member can be depressed into said cutout to a second depth, said second depth being greater than said first depth; and (d) a pipette tip coupled to said second end of said pipettor.

7. The pipettor assembly of claim 6, wherein said cutout is located near said second end of said body.

8. The pipettor assembly of claim 7, wherein said resilient, flexible member comprises a tube encasing said body at said cutout.

9. The pipettor assembly of claim 8, wherein said tube has an inner diameter slightly smaller than an outer diameter of said body and wherein said tube is stretchingly slid over said body to cover said cutout, said tube elastically conforming to seal said cutout.

10. The pipettor assembly of claim 9, wherein said second end of said body comprises a tapered portion configured to mate with said pipette tip.

* * * * *

UNITED STATES PATENT AND TRADEMARK OFFICE

CERTIFICATE OF CORRECTION

PATENT NO. : 5,445,797

DATED : August 29, 1995

INVENTOR(S) : Flesher

It is certified that error appears in the above-indentified patent and that said Letters Patent is hereby corrected as shown below:

In claim 1, column 6, line 13, please change "depressed into cutout" to --depressed into said cutout--;

In claim 6, column 6, line 43, please change "into said cutout to a first and" to --into said cutout to a first depth and--.

Signed and Sealed this

Thirty-first Day of October 1995

*Attest:*

BRUCE LEHMAN

*Attesting Officer*

*Commissioner of Patents and Trademarks*